US006073425A

United States Patent [19]

Chin-Chang et al.

[11] Patent Number: 6,073,425

[45] Date of Patent: Jun. 13, 2000

[54] GUIDE FRAME OF LASHING TAPE OF BINDING MACHINE

[75] Inventors: Liu Chin-Chang; Su Chi-Chan, both of Taichung, Taiwan

[73] Assignees: Tekpak Corporation, Taichung; Transpak Equipment Corporation, Taipei, both of Taiwan

[21] Appl. No.: 09/318,069

[22] Filed: May 24, 1999

[51] Int. Cl.[7] ..... B65B 13/04

[52] U.S. Cl. ..... 53/589; 100/26

[58] Field of Search ..... 53/582, 589; 100/25, 100/26

[56] References Cited

U.S. PATENT DOCUMENTS 5,249,518 10/1993 Abrams ..... 53/589

5,251,544 10/1993 Abrams ..... 53/589

FOREIGN PATENT DOCUMENTS 3346598 10/1984 Germany ..... 100/26

*Primary Examiner*—Linda Johnson

*Attorney, Agent, or Firm*—Harrison & Egbert

[57] ABSTRACT

A binding machine is provided with a guide frame structure for holding and guiding a lashing tape. The guide frame structure includes an inverted U-shaped guide support mounted on the top of a machine body of the binding machine, a connection rod member capable of being actuated by a cam of the binding machine so as to link a guide member. The guide frame structure further includes a lashing tape guiding frame and a position controlling guide frame capable of actuating the lashing tape guiding frame to open or close relative to the guide support for guiding out the lashing tape via a tape guiding plate.

1 Claim, 8 Drawing Sheets

GUIDE FRAME OF LASHING TAPE OF BINDING MACHINE

FIELD OF THE INVENTION

The present invention relates generally to a binding machine, and more particularly to a frame for guiding a lashing tape of the binding machine.

BACKGROUND OF THE INVENTION

As shown in FIGS. 1–4, a binding machine 10 of the prior art is provided on the top thereof with an inverted U-shaped frame 11, and a plurality of blades 12 which are fastened pivotally with the frame 11 by a plurality of bolts 14 in conjunction with a plurality of torsion springs 13. A lashing tape 15 of the binding machine 10 is disposed between each blade 12 and the frame 11. When the binding machine 10 is started, the lashing tape 15 is pulled out via the underside of one side of the frame 11. In the meantime, a blade 121 is actuated to move outwards while another blade 122 is linked to move outward, as shown in FIGS. 3 and 4. In other words, all blades 12 are sequentially actuated by the lashing tape 15 to move outward, thereby resulting in the lashing tape 15 being pulled out via the underside of one side of the frame, so as to fasten a package.

Such a prior art frame as described above for guiding the lashing tape of the binding machine is defective in design in that the lashing tape 15 can be obstructed by the blades 12 at the time when the lashing tape 15 is being pulled out to fasten a package and the like. In addition, the torsion springs 13 are vulnerable to fatigue, thereby causing the torsion springs 13 to have uneven resetting forces. As a result, the lashing tape 15 can not be guided out with stability. Moreover, the quality of binding a package and the like with the lashing tape 15 is often undermined by the mechanical friction and interference of the lashing tape 15 by the blades 12. The mechanical friction between the blades 12 and the lashing tape 15 brings about noise that irritates the machine operator. Such an annoying noise is also brought about by the collision between the frame 11 and the blades 12 at the time when the lifted blades 12 return to their original positions.

SUMMARY OF THE INVENTION

It is therefore the primary objective of the present invention to provide a binding machine with an improved frame for guiding a lashing tape with precision, so as to improve the binding quality.

It is another objective of the present invention to provide a binding machine with a guide frame of a lashing tape. The guide frame is capable of guiding the lashing tape during the binding process without bringing about an annoying noise.

It is still another objective of the present invention to provide a binding machine with a guide frame comprising a connection rod member and a guide member which is actuated by the connection rod member to guide a position controlling guide frame for guiding the lashing tape to move along a tape guiding plate with stability.

The foregoing objectives, features, functions, and advantages of the present invention will be more readily understood upon a thoughtful deliberation of the following detailed description of a preferred embodiment of the present invention with reference to the accompanying drawings.

DETAILED DESCRIPTION OF THE EMBODIMENT

Figure 1:
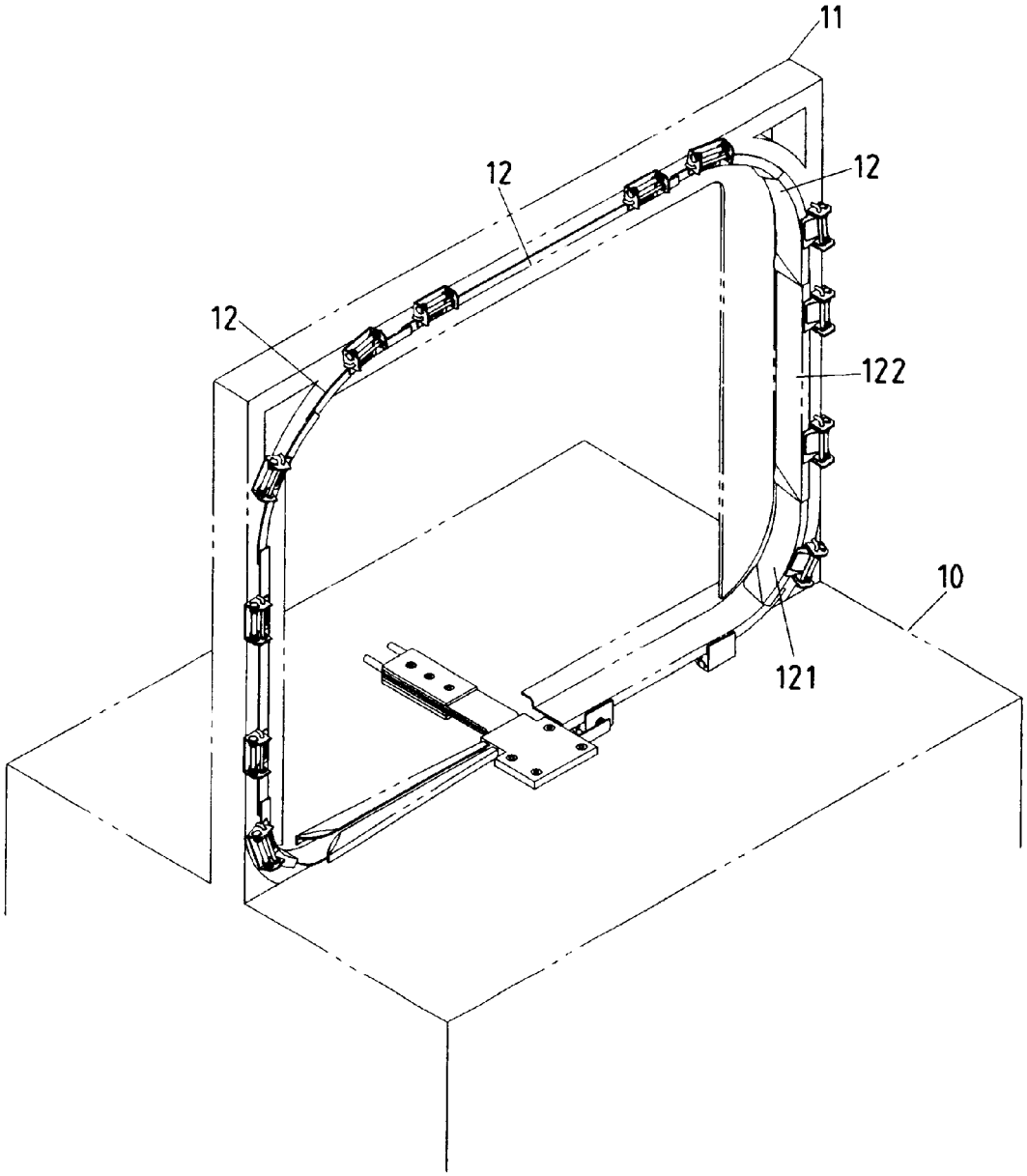
FIG.1 PRIOR ART
FIG. 1 shows a perspective view of a prior art guide frame of a lashing tape of a binding machine.
Figure 2:
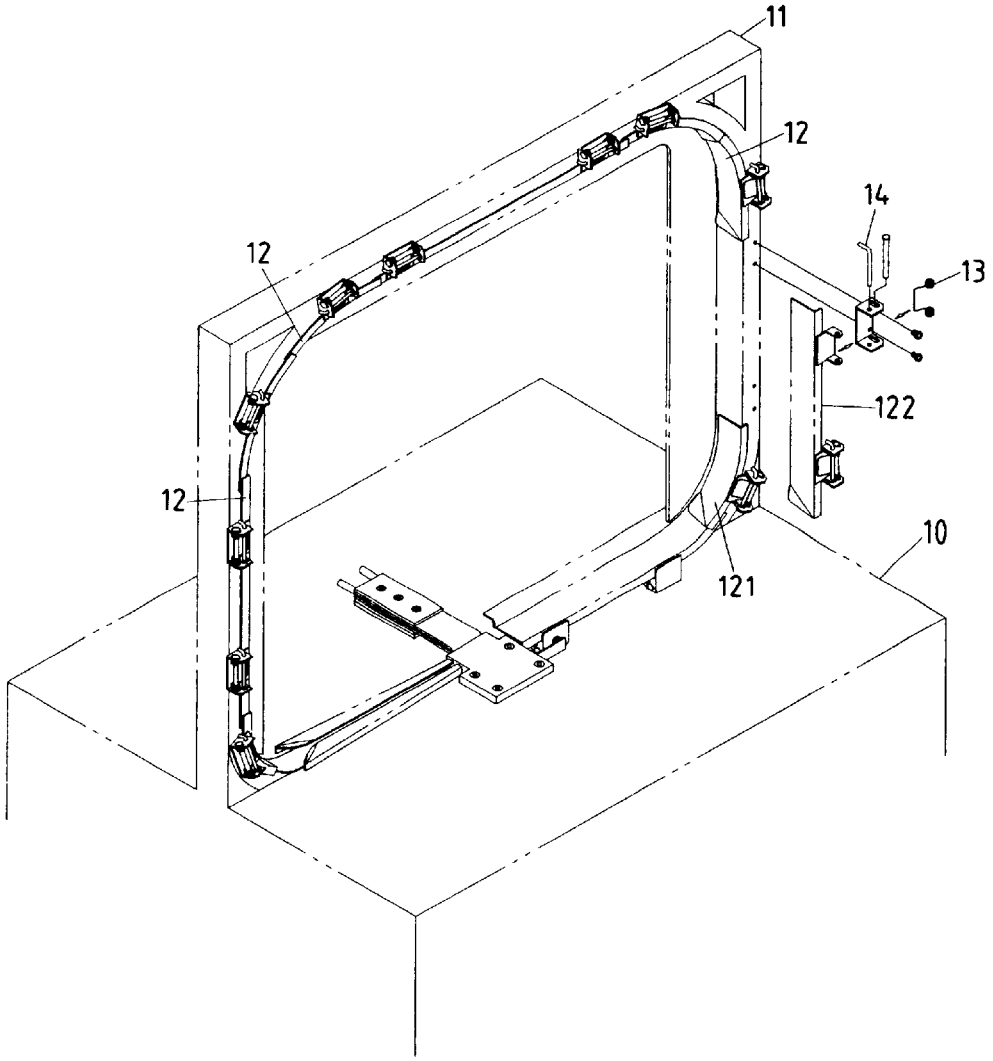
FIG. 2 PRIOR ART
FIG. 2 shows a partial exploded view of the prior art guide frame as shown in FIG. 1.
Figure 3:
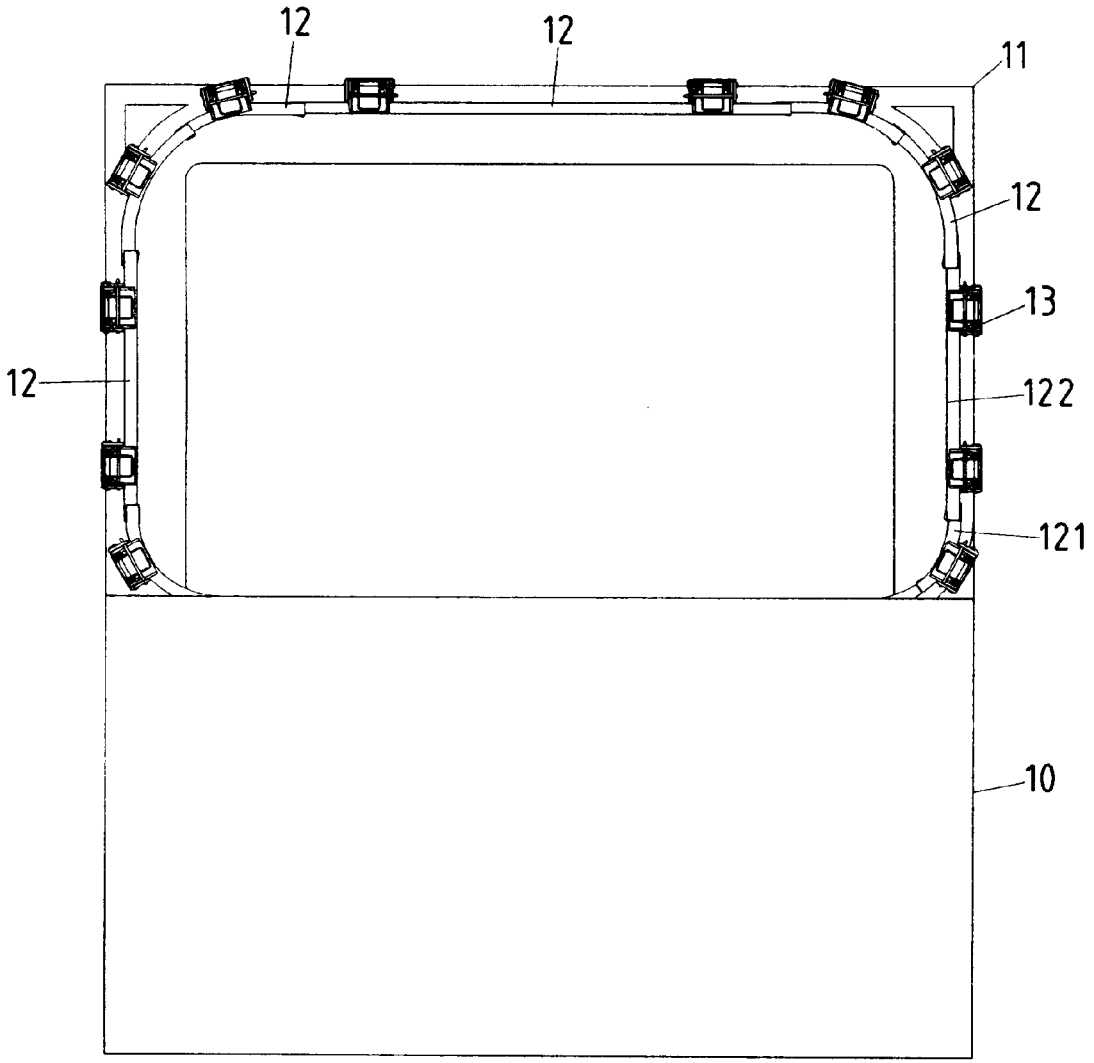
FIG.3 PRIOR ART
FIG. 3 shows a plan view of the prior art guilde frame as shown in FIG. 1.
Figure 4:
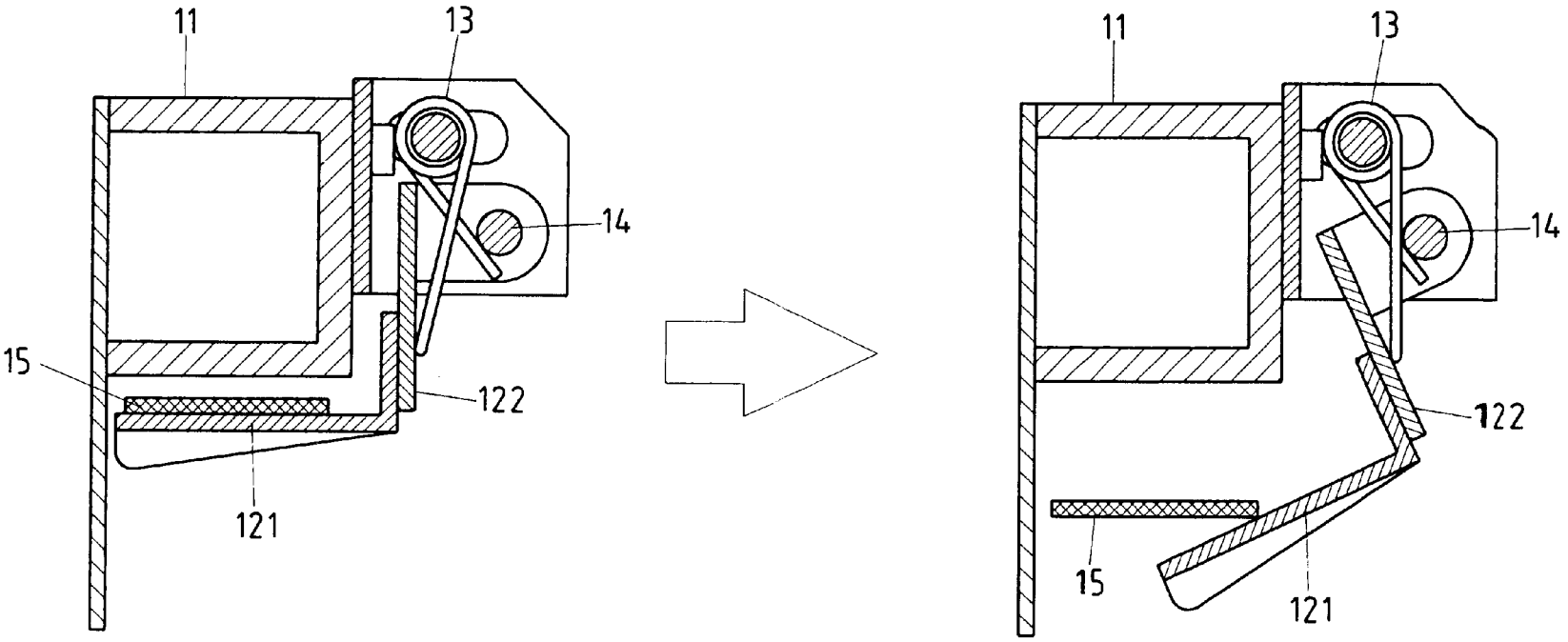
FIG. 4 PRIOR ART
FIG. 4 shows a schematic view of the lashing tape being guided out by the prior art guide frame as shown in FIG. 1.
Figure 5:
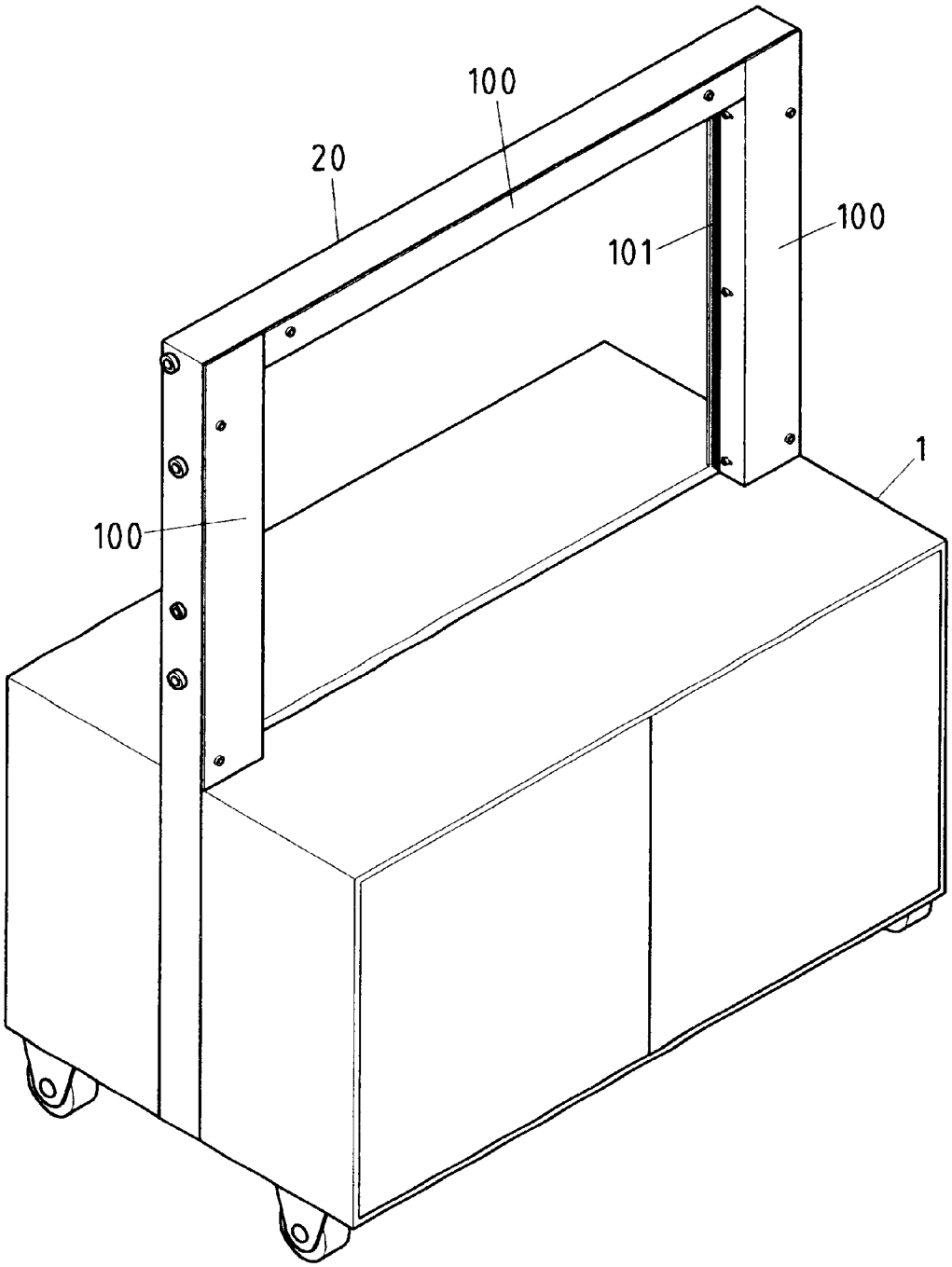
FIG. 5 shows a perspective view of the preferred embodiment of the present invention.

As shown in FIGS. 5–8, a guide frame structure embodied in the present invention is intended to guide a lashing tape of a binding machine and is composed of the component parts which are described hereinafter.

An inverted U-shaped guide support 20 is mounted on the top of a machine body 1 of the binding machine and is formed of two upright guide rods 21, a cross guide rod 22 connecting the top ends of the two upright guide rods 21, and a face plate 23 fastened with the inner side of one of the two upright guide rods 21.

A connection rod member is formed of a driven rod 31, a top rod 35 parallel to the driven rod 31, and a shaft rod 32 connecting the ends of the driven rod 31 and the top rod 35 and having two seat blocks 33 and 34 which are mounted thereon. The top rod 35 is contiguous to the inner side of one of the two upright rods 21 and is fastened at one end thereof with a first connection rod 36 and at the top thereof with a second connection rod 37 which is in turn fastened with a projection 39 of a top cross shaft 38. The top cross shaft 38 is provided at other end thereof with a projection 40 which is connected with a third connection rod 41. The top cross shaft 38 is fastened at both ends thereof with the two upright guide rods 21 by a plurality of screws 42.

A guide member is formed of two longitudinal guide rods 50 and 51, which are provided respectively with two longitudinal holes 52 opposite to each other, and a receiving hole 53 located between the two longitudinal holes 52. The guide rods 50 and 51 are fastened with the two upright guide rods 21 by a plurality of bolts 54 which are received in the longitudinal holes 52. The receiving holes 53 of the guide rods 50 and 51 hold respectively a spring 55 which is fastened with the upright guide rods 21 by a bolt 56. The guide rods 50 and 51 are provided with a slanted guide block 57. The guide rod 50 is fastened with the first connection rod 36 by a bolt 58, and with the second connection rod 37 and the third connection rod 41 by bolts 59.

A lashing tape guiding frame 70 is provided with a slot 71, and four through holes 74 which are located at four corners 73 and are in communication with the slot 71.

A position controlling guide frame 80 is of a rectangular construction and is slightly greater than the lashing tape guiding frame 70. The position controlling guide frame 80 has two longitudinal rods 81 which are provided with two guide wheels 82 fastened therewith. The position controlling guide frame 80 has two cross rods 83 which are provided with a ferrule 84. The position controlling guide frame 80 is fastened with the lashing tape guiding frank 70 by a plurality of screws 85. The position controlling guide frame 80 and the lashing tape guide frame 70 are mounted on the face plate 23 by means of the ferrules 84 in conjunction with bolts 86 and springs 87. The guide wheels 82 are located on the top edges of the slanted guide blocks 57 of the guide rods 50 and 51.

A plurality of urging pin members 90 are received in the through holes 74 of the four corners 73 of the lashing tape guide frame 70. The urging pin members 90 are provided with a plate piece 91 which is fastened at one end thereof with an urging pin 92 which is received in the slot 71 via the through hole 74 of the lashing tape guiding frame 70. The plate piece 91 is fastened at one end thereof with the face plate 23 of the guide support 20 by a plurality of fastening bolts 93 such that the plate piece 91 is separated from the position controlling guide frame by an interval 94.

A plurality of tape guiding plates 100 are fastened respectively with the two upright guide rods 21 and one cross rod 22 of the guide support 20. The tape guiding plates 100 are provided with a brush 101 contiguous to the face plate 23 of the guide support 20.

Figure 6:
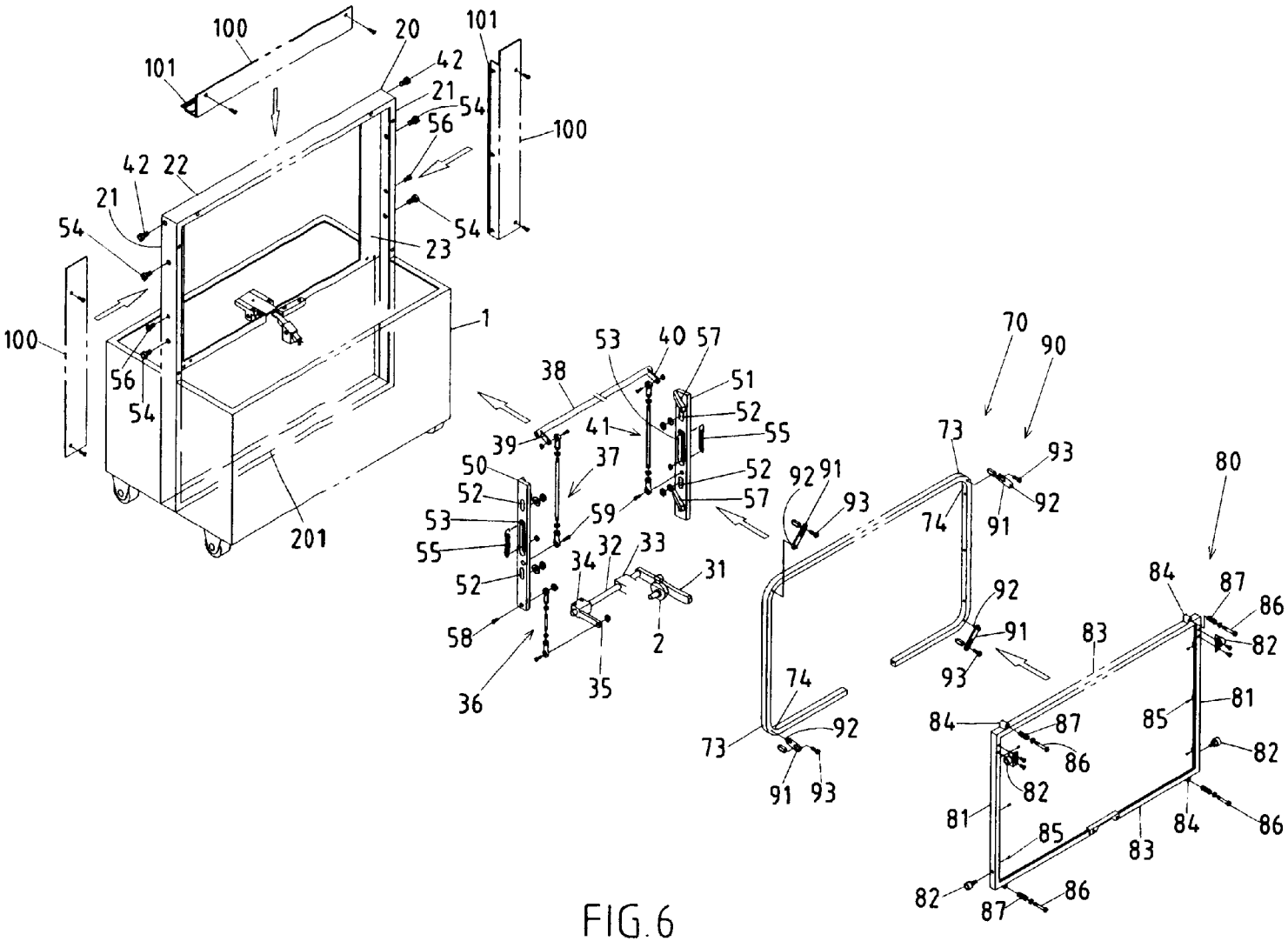
FIG. 6 shows an exploded view of the preferred embodiment of the present invention.
Figure 8:
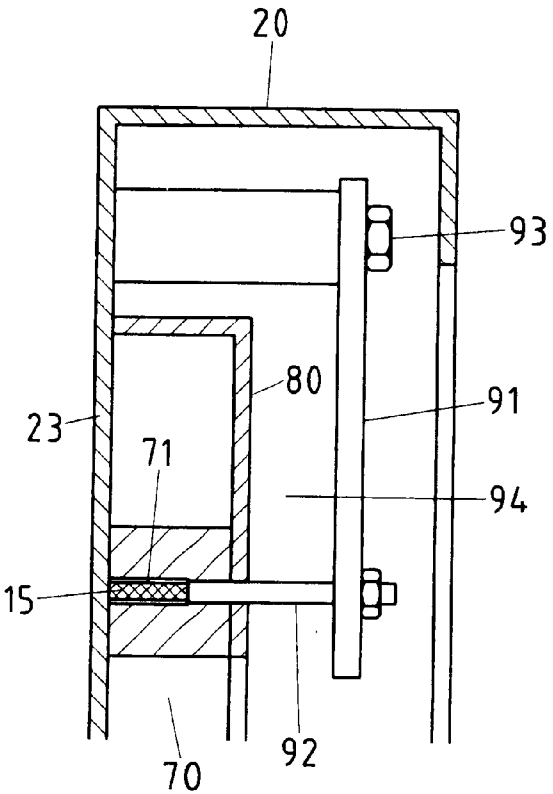
FIG. 8 shows a schematic plan view of a lashing tape being disposed in the guide frame of the preferred embodiment of the present invention.
Figure 7:
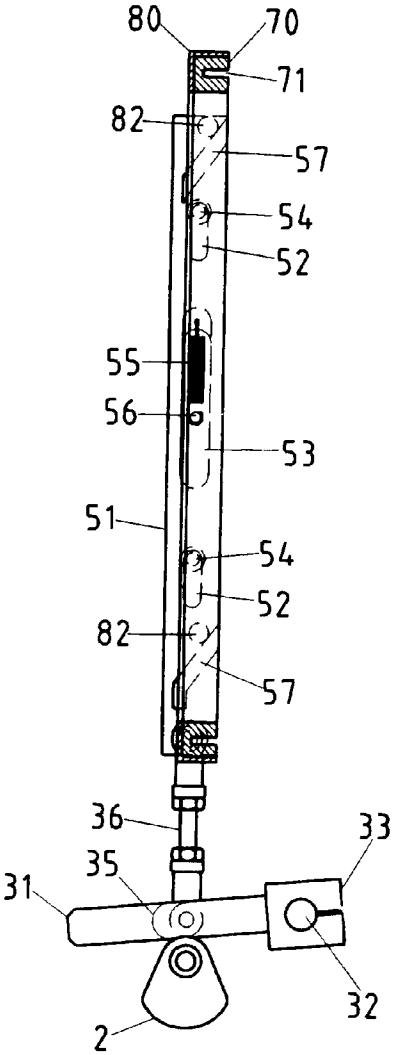
FIG. 7 shows a schematic plan view of the preferred embodiment of the present invention in the state of being located.

As shown in FIGS. 6, 7, and 8, when the present invention remains in the locating state, the driven rod 31 is not actuated by a cam 2 to swivel downward. As a result, the guide rods 50 and 51 can not be actuated by the connection rod member while the guide wheels 82 are located at the top edges of the slanted guide blocks 57 of the guide rods 50 and 51. In the meantime, the slot 71 of the lashing tape guide frame 70 is in contact with the surface of the face plate 23, whereas the urging pins 92 of the urging pin members 90 are in contact with the lashing tape 15 via the slot 71 of the lashing tape guiding frame 70.

Figure 10:
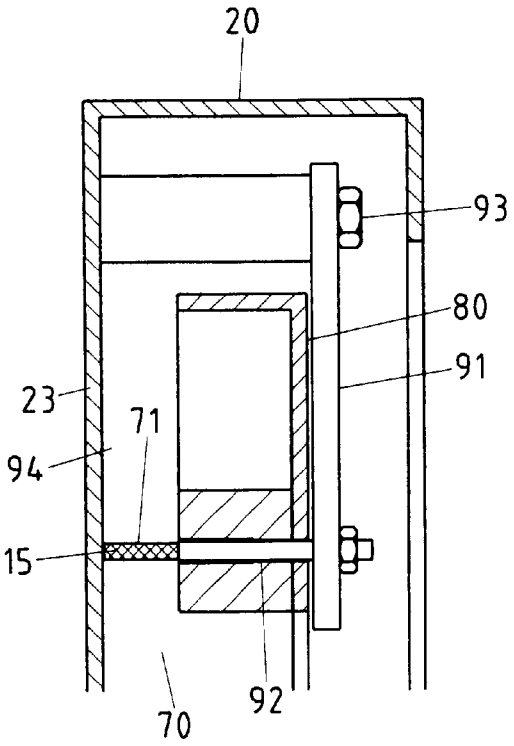
FIG. 10 shows a schematic plan view of the lashing tape which has been guided out of the guide frame of the preferred embodiment of the present invention.
Figure 9:
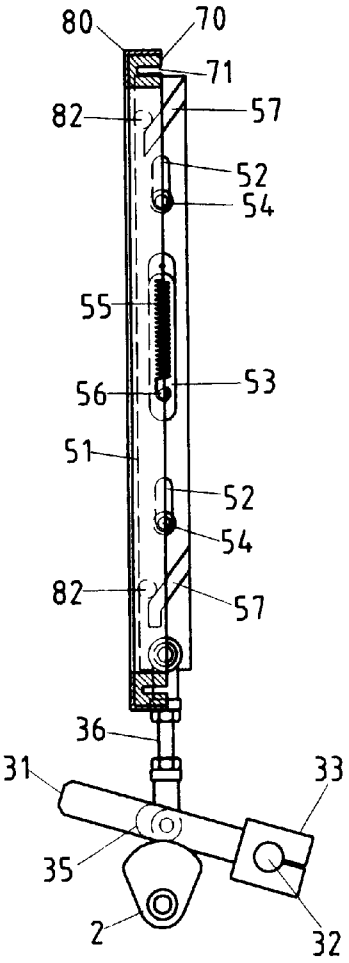
FIG. 9 shows a schematic plan view of the lashing tape being guided out by the guide frame of the preferred embodiment of the present invention.

As shown in FIGS. 6, 9, and 10, the cam 2 is in operation to push the driven rod 31 upwards so as to actuate the shaft rod 32 and the urging rod 35 to push the first connection rod 37 upward, thereby causing the cross shaft 38 to rotate such that the third connection rod 41 is actuated by the other end of the cross shaft 38 to lift the second guide rod 51. As a result, the position controlling guide frame 80 is spread out by the guide wheels 82 making use of the slanted guide blocks 57, so as to cause the slot 71 of the lashing tape guide frame 70 to separate from the surface of the face plate 23. At the time when the position controlling guide frame 80 is spread out, the lashing tape 15 is pushed out of the slot 71 by the urging pins 92. The lashing tape 15 is then held and guided by the brush 101 of the tape guiding plate 100 before a package is lashed with the lashing tape 15. As soon as the package is lashed with the lashing tape 15, the lashing tape 15 is severed. Thereafter, all component parts that are involved in the lashing process described above are caused by the resetting forces of the springs 55 and 87 to return to their original position so as to be ready for a second round of the lashing process.

As shown in FIG. 6, the construction of the guide support 20 is further strengthened by a bottom cross rod 201 connecting the bottom ends of the two upright guide rods 21 of the guide support 20.

The embodiment of the present invention described above is to be regarded in all respects as being merely illustrative and not restrictive. Accordingly, the present invention may be embodied in other specific forms without deviating from the spirit thereof. The present invention is therefore to be limited only by the scope of the following appended claim.

We claim:

1. A guide frame structure for guiding a lashing tape of a binding machine, the guide frame structure comprising:

a machine body;

an inverted U-shaped guide support mounted on a top of said machine body, said guide support being formed of two upright guide rods and a cross guide rod connected to respective top ends of said two upright guide rods and a face plate fastened to an inner side of one of said two upright guide rods;

a connection rod member comprising a driven rod and a top rod parallel to said driven rod and a shaft rod connecting respective ends of said driven rod and said top rod, said shaft rod having two seat blocks, said top rod being contiguous to said inner side of one of said two upright rods, said top rod fastened at one end thereof to a first connection rod, said top rod fastened at a top thereof with a second connection rod, said second connection rod being fastened to a projection of a top cross shaft, said top cross shaft having another projection at an end thereof, said another projection connected to a third connection rod, said top cross shaft being fastened by a plurality of screws at ends thereof respectively with said two upright guide rods;

a guide member comprising two longitudinal guide rods, said two longitudinal guide rods having respectively two longitudinal holes opposite in location to each other, said two longitudinal guide rods being fastened respectively with said two upright guide rods by a plurality of fastening bolts which are received respectively in said two longitudinal holes, each of said two longitudinal guide rods having a slanted guide block, one of said two longitudinal guide rods being fastened to said first connection rod and to said second connection rod and to said third connection rod;

a lashing tape guiding frame having a slot formed therein, said lashing tape guiding frame having four through holes located respectively at four corners of said lashing tape guiding frame, said four through holes communicating with said slot;

a position controlling guide frame comprising two longitudinal rods with two guide wheels respectively fastened thereto, said position controlling guide frame further comprising two cross rods and a ferrule, said position controlling guide frame being fastened to said lashing tape guiding frame by a plurality of screws such that said two guide wheels are located on top edges of said slanted guide blocks of said two longitudinal guide rods;

a plurality of urging pin members received respectively in said four corners of said lashing tape guiding frame, said lashing tape guiding frame having a plate piece fastened at one end thereof with one of said plurality of urging pin members, said one of said plurality of urging pin members being received in said slot of said lashing tape guiding frame and through one of said through holes of said lashing tape guiding frame, said plate piece being fastened at one end thereof with said face plate of said guide support such that said plate piece is separated from said position controlling guide frame by an interval; and a plurality of tape guiding plates fastened to said two upright guide rods and said cross guide rod of said guide support, said plurality of tape guiding plates having a brush contiguous to said face plate of said guide support for holding and guiding a lashing tape.

* * * * *